United States Patent [19]

Kee

[11] Patent Number: 4,662,250

[45] Date of Patent: May 5, 1987

[54] DEVICE FOR USE IN REMOVING SCREW CLOSURES FROM CONTAINERS

[76] Inventor: Thomas S. G. Kee, 4 Cultra Avenue, Holywood, County Down, United Kingdom

[21] Appl. No.: 798,806

[22] Filed: Nov. 14, 1985

[51] Int. Cl.[4] ..... B67B 7/18

[52] U.S. Cl. ..... 81/3.25; 81/3.4

[58] Field of Search ..... 81/3.4, 3.25, 3.33

[56] References Cited

U.S. PATENT DOCUMENTS

| | | | |
|---|---|---|---|
| 1,954,422 | 4/1934 | McIntyre | 81/3.4 |
| 1,960,531 | 5/1934 | Driscoll | 81/3.4 |
| 2,761,337 | 9/1956 | Daniel | 81/3.4 |
| 3,583,263 | 6/1971 | Herigstad | 81/3.4 |
| 3,600,982 | 10/1971 | Tholen . | |
| 3,604,290 | 9/1971 | Waite | 81/3.4 |
| 4,001,904 | 1/1977 | Gill . | |
| 4,085,632 | 4/1978 | Hogan et al. . | |

FOREIGN PATENT DOCUMENTS

| | | |
|---|---|---|
| 1568683 | 6/1980 | United Kingdom . |
| 2106479A | 4/1983 | United Kingdom . |

OTHER PUBLICATIONS

Search Report of British Patent Office for Great Britain Serial No. 84 12253 (Dec. 12, 1985), Wo 83/02265–International Appl. No. PCT/AU82/00218.

*Primary Examiner*—Roscoe V. Parker

*Attorney, Agent, or Firm*—Mason, Fenwick & Lawrence

[57] ABSTRACT

A device for use in removing screw closures from containers comprises a body having a recess therein of substantially complementary frusto-conical or bell shape being to accommodate a screw-closure of a container. Converging wall portions being provided in said recess with the inner surface thereof being of, or having secured thereto a lining of, a material having a frictional adherence or resistence property with any screw closure located in contact therewith and having relative rotational movement caused therebetween by rotation of the container or of the body. A bracket is provided to enable the body to be wall- or shelf-mounted, two cheeks of the bracket being similarly apertured and the body having a bore whose axis is alignable with those of the apertures to enable a pin to be locatable therethrough to readily secure the body to the bracket. The bore in the body has its axis at right angles to the axis of the body.

8 Claims, 6 Drawing Figures

14
18
16
10A
12
15
24
10
11
13
25
17

DEVICE FOR USE IN REMOVING SCREW CLOSURES FROM CONTAINERS

This invention relates to a device for use in removing or tightening screw closures from or on to containers, such as bottles or jars, and is for particular, but not exclusive, use by a person who does not have full hand-gripping power due to, for example, a medical condition, such as arthritis.

In accordance with the present invention, a device comprises a body having a recess therein shaped to accommodate a screw-closure of a container, converging wall portions being provided in said recess with the inner surface thereof being of, or having secured thereto a lining of, a material having a frictional adherence or resistance property with any screw closure located in contact therewith and having relative rotational movement caused therebetween by rotation of the container or of the body.

Preferably, the body is for manual manipulation. The shape of the body may be a campana or discus. The recess is of shape substantially complementary to a frusto-conical or bell shape with the recess tapering inwardly.

Preferably also, a bracket is provided to enable the body to be wall or shelf-mounted, two cheeks of the bracket being similarly apertured and the body having a bore whose axis is alignable with those of the apertures to enable a pin to be locatable therethrough to readily secure the body to the bracket. The bore in the body has its axis at right angles to the axis of the body.

Embodiments of the present invention will now be described, by way of example, with reference to the accompanying drawings, in which.

Figure 1:
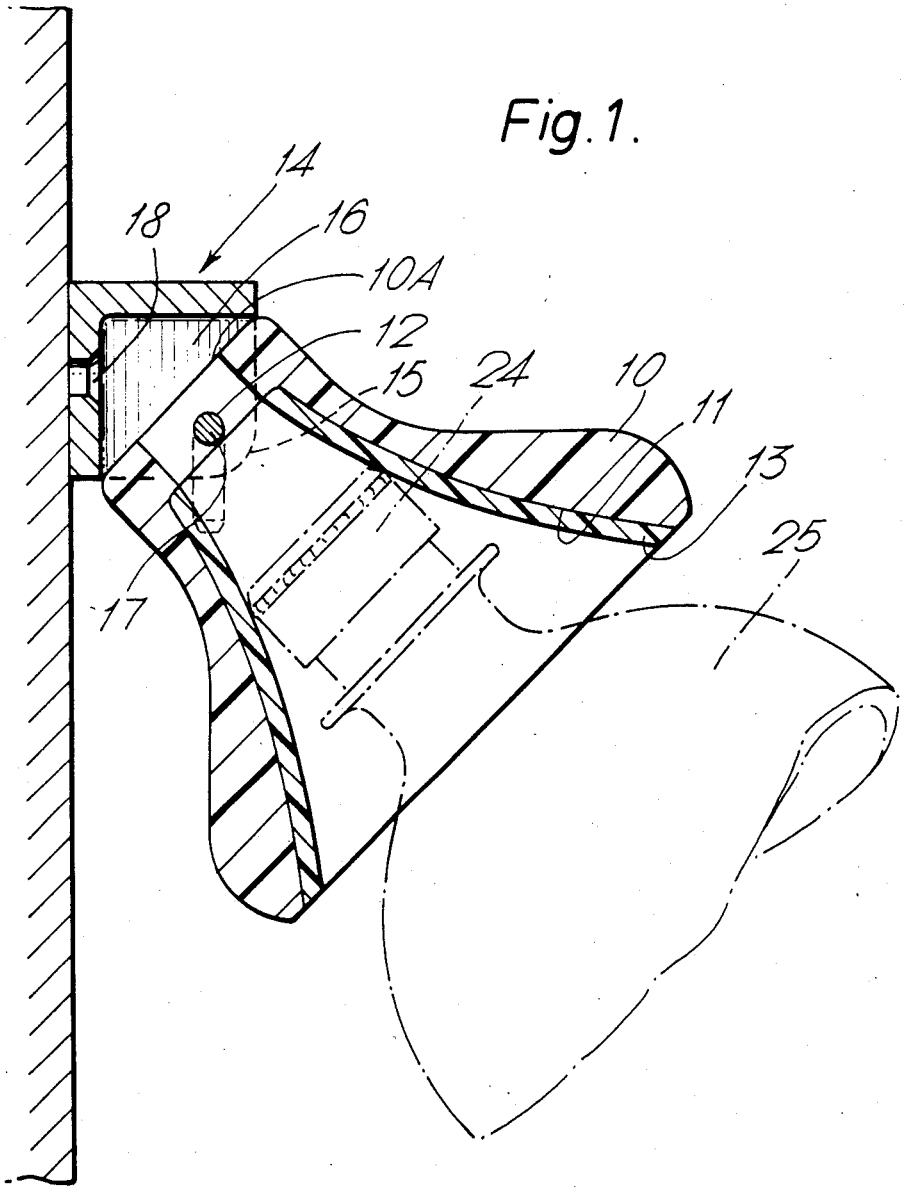
FIG. 1 shows a vertical cross-section along the rotational axis of a device according to a first embodiment of the present invention for use on removing screw closures for containers, the device being shown in a wall-mounted attitude and the upper portion of a container being shown in broken line with its screw-closure located in the device.
Figure 4A:
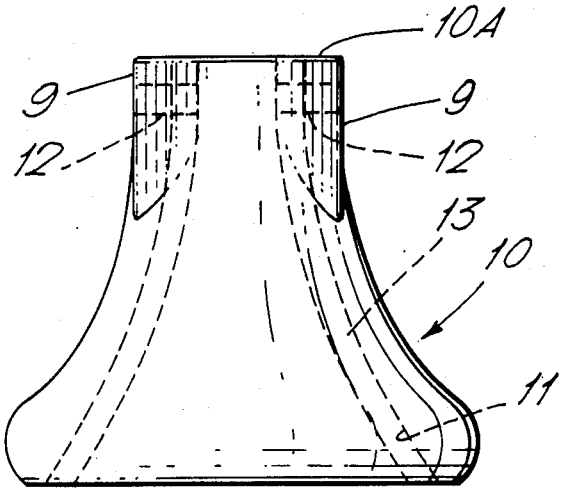
FIGS. 4A and 4B show a side view and a plan view respectively of the device.
Figure 4B:
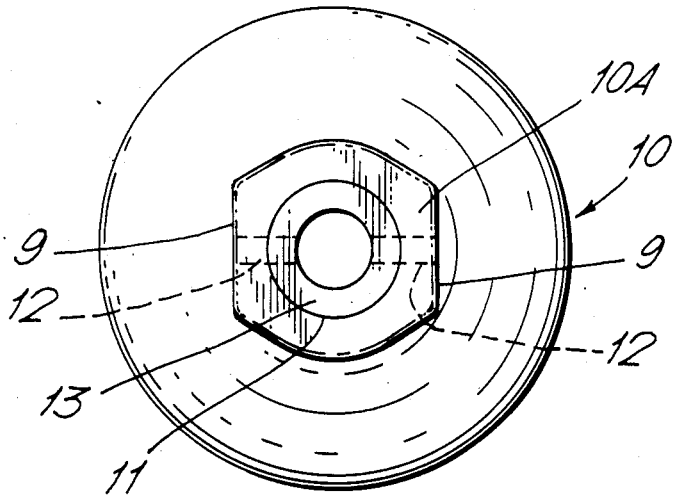

Referring to FIGS. 1, 4A and 4B of the drawings, the device according to a first embodiment comprises a body 10 of bell-shape with a flat top 10A, the body 10 having a recess 11, the outer portion of which is also bell-shaped with the inner portion being of frusto-conical shape. The body 10 is squared off adjacent to its top 10A to provide two opposite cheeks 9. Adjacent to top 10A, a bore 12 is provided whose axis is at right angles to the axis of the body 10 and extends between said two cheeks 9. The wall of the recess is lined with a liner 13 of a material (such as natural or synthetic rubber, or a plastics material, for example poly-vinyl-chloride (P.V.C.) having a high frictional adherence/resistance property with a screw closure located in contact therewith and when relative rotational movement is caused therebetween.

Figure 3A:
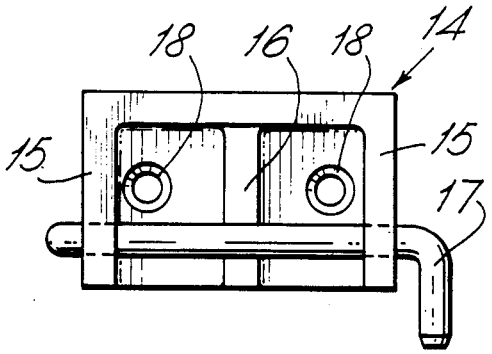
FIGS. 3A and 3B show a front view and a side view respectively of a wall-mountable bracket.
Figure 3B:
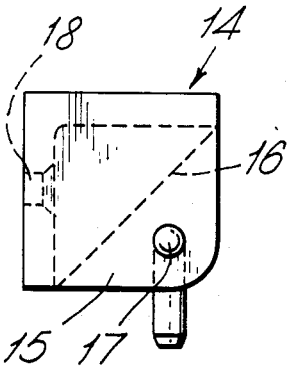

A wall or shelf-mountable bracket 14 shown in FIGS. 3A and 3B is provided to enable the above-shaped body to be fitted to a wall or under a shelf. The bracket 14 is elongate and of angular cross-section as shown having at each end a cheek 15 to mate with the cheeks 9. Intermediate the cheeks 15, a web 16 is provided whose outer face is at 45 angular degrees to each wall of the bracket. Two screw holes 18 are provided in one wall of the bracket as shown and depending on whether the bracket is to be wall- or shelf-mounted determines whether the holed wall is to be vertically or horizontally positioned respectively. Both cheeks 15 are similarly apertured and the body above-described is positioned with its flat top 10A abutting the web face, the cheeks 9 and 15 abutting, and the axes of the apertures and bore 12 are aligned and a pin 17 is located therethrough so to hold the body in a mounted position with its axis at 45 angular degrees to the wall or shelf.

Figure 2:
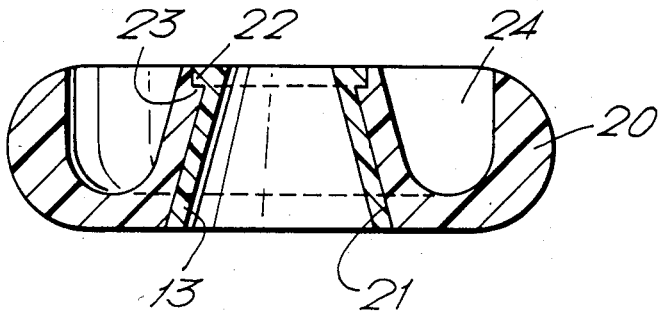
FIG. 2 shows a vertical cross-section along the rotational axis of a device according to a second embodiment.

In FIG. 2 in a second embodiment, the body 20 is in the shape of a discus and the recess 21 is frusto-conical exiting at both top and bottom of the body. A lip 22 is provided on the liner 13 to mate with a complementary rebate 23 in the body as shown.

The body 10 or 20 is of wood or of plastics material and in FIG. 2, the body is shown as being annularly grooved or rebated at 24 to lighten the weight of the body.

Radial retaining ribs (no shown) can be provided to locate in complementary channels (not shown) provided on the inside surface of the recess 11 thereby to prevent movement of the liner relative to the body during use.

Scalloping or knurling for easy grip may be provided on the outside of the body in either embodiment for ease in rotation of the body relative to a stationary container.

In use, a device is placed over a screw-closure of a container or a screw-closure placed into the recess of a device and by holding one stationary and by downward pressure and rotation of the other, the screw-closure is loosened from the container. When the body is wall- or shelf-mounted, the screw-closure of the container is located in the recess 11 and the container rotated to loosen the screw-closure.

The device above-described may have a body of shape other than that described provided it is suitable for hand gripping, for example a bell-shape. Also, without departing from the scope of the invention, two frusto-conical or bell-shaped recesses may be provided in back-to-back relationship, the recess impinging on one another or intercommunicating through a bore with one another.

The device as shown in FIG. 1 and as above-described can be used to loosen a range of differently diametered screw-closures.

Also without departing from the scope of the invention the lining may not be provided around the full face of the recess and may be simply wall portions stuck to the recess.

I claim:

1. A device for removing a screw-closure from a container comprising a body having a recess therein shaped to accommodate a screw-closure of a container, said body also having a longitudinal axis, converging wall portions being provided in said recess with the inner surface thereof having a lining of a material having a frictional adherence or resistance property with any screw closure located in contact therewith and having relative rotational movement caused therebetween by rotation of the container or of the body, the inner surface of said lining being the shape of a bell having an outwardly curving wall, whereby said device can accommodate a maximum range of screw-closure sizes within a limited distance along said vertical axis.

2. A device according to claim 1, wherein the exterior of said body is in the shape of a bell conforming approximately to the shape of the said lining, whereby the device can be hand-held.

3. A device according to claim 1, further including bracket means for attaching said body to a planar surface.

4. A device according to claim 1, further including bracket means for attaching said body to a planar surface with said longitudinal axis of said body at an angle of approximately 45° to the plane of the surface, whereby said device can be used attached to either a vertical surface or to the underside of a shelf.

5. A device according to claim 4, said bracket means comprising a pair of spaced-apart cheeks, said cheeks being similarly apertured and having an axis through said apertures, and said body having a bore therethrough, said bore having an axis alignable with said axis through said apertures, and pin means locatable through said apertures for securing said body to said bracket means.

6. The device of claim 5, said axis of said bore being substantially perpendicular to said longitudinal axis of said body.

7. The device of claim 5, said bore being adjacent the top of said body and said body being provided at the top with two opposed cheeks, said bore extending between said cheeks.

8. The device of claim 6, said bore being adjacent the top of said body and said body being provided at the top with two opposed cheeks, said bore extending between said cheeks.

* * * * *